US008277017B2

(12) United States Patent
Sakamaki et al.

(10) Patent No.: US 8,277,017 B2
(45) Date of Patent: Oct. 2, 2012

(54) IMAGE FORMING AND IMAGE CUTTING APPARATUS

(75) Inventors: Hideyuki Sakamaki, Chiba (JP); Tsunejiro Ioka, Chiba (JP)

(73) Assignee: Seiko I Infotech Inc. (JP)

( * ) Notice: Subject to any disclaimer, the term of this patent is extended or adjusted under 35 U.S.C. 154(b) by 390 days.

(21) Appl. No.: 12/449,634

(22) PCT Filed: Feb. 4, 2008

(86) PCT No.: PCT/JP2008/051788

§ 371 (c)(1), (2), (4) Date: Oct. 15, 2009

(87) PCT Pub. No.: WO2008/102636

PCT Pub. Date: Aug. 28, 2008

(65) Prior Publication Data

US 2010/0091062 A1 Apr. 15, 2010

(30) Foreign Application Priority Data

Feb. 24, 2007 (JP) ..... 2007-044781

(51) Int. Cl.
*B41J 29/393* (2006.01)

(52) U.S. Cl. ..... 347/19; 347/16; 347/104; 347/101

(58) Field of Classification Search ..... 347/16, 347/19, 104, 101
See application file for complete search history.

(56) References Cited

U.S. PATENT DOCUMENTS

| | | | | |
|---|---|---|---|---|
| 6,604,820 | B1 * | 8/2003 | Fukuda | 347/104 |
| 6,832,824 | B1 * | 12/2004 | Baker et al. | 347/19 |
| 2005/0225595 | A1 * | 10/2005 | Ohmori et al. | 347/37 |
| 2005/0270352 | A1 * | 12/2005 | Iwase et al. | 347/104 |

FOREIGN PATENT DOCUMENTS

| | | |
|---|---|---|
| JP | 56176860 | 12/1981 |
| JP | 09066698 | 3/1997 |

* cited by examiner

*Primary Examiner* — Julian Huffman
*Assistant Examiner* — Sharon A Polk
(74) *Attorney, Agent, or Firm* — Adams & Wilks

(57) ABSTRACT

An image forming and cutting apparatus has an inkjet head with a first coupling member having a hole, a cutting head with a second coupling member having a hole, and a coupling pin that is received by the holes of the coupling members to couple the first and second coupling members to each other. The coupling pin has first and tapered portions with a columnar portion interposed therebetween. The hole of the first coupling member has a tapered surface for receiving the first tapered portion, and the hole of the second coupling member has a tapered surface portion and a columnar surface portion for receiving the second tapered portion and the columnar portion, respectively. The first coupling member is made of an elastic material and is configured to be pressed and deflected by the coupling pin due to elasticity of the elastic material when the coupling pin is moved in the first direction and is received by the holes of the first and second coupling members so that the first and second coupling members are coupled to one another with a gap therebetween while the columnar portion of the coupling pin protrudes from the hole of the second coupling member.

13 Claims, 5 Drawing Sheets

IMAGE FORMING AND IMAGE CUTTING APPARATUS

CROSS-REFERENCE TO RELATED APPLICATIONS

This application is a U.S. national stage application of International Application No. PCT/JP2008/051788 filed Feb. 4, 2008, claiming a priority date of Feb. 24, 2007, and published in a non-English language.

BACKGROUND OF THE INVENTION

1. Technical Field

The present invention relates to an inkjet head that prints an image on a recording medium, which is formed based on image data, and an image forming and image cutting apparatus that cuts the recording medium.

2. Background Art

In recent years, in order to achieve downsizing and cost saving for a printing apparatus such as an inkjet printer, there has been proposed an inkjet printer integrally including an inkjet head that prints an image formed based on image data on a recording medium and a cutting head including a cutter for cutting the image printed on the recording medium. For example, Patent Document 1 discloses an inkjet printer, which includes a mechanism for coupling and separating an inkjet head and a cutting head with and from each other by using magnets attached to the inkjet head and the cutting head, respectively.

Patent Document 1: JP 2006-35510 A

However, in the inkjet printer employing the conventional coupling technology, there may arise such problems as a trouble caused by unexpected vibrations occurring at the time of coupling due to a magnetic force, and an increase in size of a drive motor resulting from a necessity of a large force acting against the magnetic force at the time of separation.

The present invention has been made in view of the above-mentioned problems inherent in the related art, and an object of the present invention is to provide an image forming and image cutting apparatus that may suppress vibrations occurring at the time of coupling an inkjet head and a cutting head, and does not require a large force acting against a magnetic force at the time of separation, thereby making it possible to achieve downsizing of a drive motor for the inkjet head or the cutting head.

SUMMARY OF THE INVENTION

In order to achieve the above-mentioned object, according to a first aspect of the present invention, an image forming and image cutting apparatus that prints a desired image on a recording medium or cuts the recording medium based on image data includes coupling means for coupling and separating or de-coupling an inkjet head from a cutting head, the inkjet head moving along a guide rail disposed perpendicularly to a traveling direction of the recording medium and printing the desired image on the recording medium, the cutting head moving along the guide rail and including a cutter blade for cutting the recording medium. The coupling means includes a first coupling member attached to the inkjet head, a second coupling member attached to the cutting head, and a movable coupling pin. The coupling means is configured to, when printing the desired image on the recording medium based on the image data, move the coupling pin, cause the coupling pin to penetrate the first coupling member and the second coupling member to thereby couple the first coupling member and the second coupling member with each other, and integrally move the inkjet head and the cutting head along the guide rail to thereby print the desired image on the recording medium based on the image data. When cutting the recording medium, the coupling means is configured to retract the coupling pin to cancel the coupling, separate the first coupling member and the second coupling member from each other, and move the cutting head alone along the guide rail, to thereby cut the recording medium.

According to a second aspect of the present invention, in the image forming and image cutting apparatus according to the first aspect of the present invention, the coupling pin has a shape corresponding to a shape of the first coupling member and a shape corresponding to a shape of the second coupling member.

According to a third aspect of the present invention, in the image forming and cutting apparatus according to the first aspect or the second aspect of the present invention, each of the first coupling member and the second coupling member has a hole processed so as to coincide in shape with the coupling pin.

According to a fourth aspect of the present invention, in the image forming and image cutting apparatus according to any one of the first to third aspects of the present invention, the first coupling member includes an elastic member, and is pressed and deflected by the coupling pin when the coupling pin is moved, to thereby be fitted with the coupling pin due to elasticity of the first coupling member.

According to a fifth aspect of the present invention, in the image forming and image cutting apparatus according to any one of the first to fourth aspects of the present invention further includes detection means for detecting positions of holes in the first coupling member and in the second coupling member, in which the detection means includes: a first detection means attached to the inkjet head; a second detection means attached to the cutting head; and a scale disposed along the guide rail.

According to a sixth aspect of the present invention, in the image forming and image cutting apparatus according to the sixth aspect of the present invention, the detection means detects the positions of the holes in the first coupling member and in the second coupling member by reading the scale using reading sensors attached to the first detection means and the second detection means, respectively.

According to a seventh aspect of the present invention, in the image forming and image cutting apparatus according to any one of the first to sixth aspects of the present invention, the coupling pin is moved in a predetermined direction by pin moving means.

According to an eighth aspect of the present invention, in the image forming and image cutting apparatus according to the seventh aspect of the present invention, the pin moving means includes a solenoid, and the solenoid is fixed to one of the inkjet head and the cutting head.

The image forming and image cutting apparatus according to the present invention provides such an excellent effect that vibrations occurring at the time of coupling the inkjet head and the cutting head are suppressed, to thereby achieve downsizing of the drive motor for the inkjet head or the cutting head.

BRIEF DESCRIPTION OF THE DRAWINGS

FIGS. 2A and 2B are views each illustrating a separated state of an inkjet head and a cutting head of the image forming and image cutting apparatus according to the present invention, in which FIG. 2A is a front view, and FIG. 2B is a top view.

FIGS. 3A and 3B are views each illustrating a coupled state of the inkjet head and the cutting head of the image forming and image cutting apparatus according to the present invention, in which FIG. 3A is a front view, and FIG. 3B is a top view.

FIGS. 4A and 4B are views each illustrating an operation of a coupling pin of the image forming and image cutting apparatus according to the present invention, in which FIG. 4A is a view illustrating a state in the course of coupling, and FIG. 4B is a view illustrating a state after the coupling.

DESCRIPTION OF REFERENCE SYMBOLS

Figure 1:
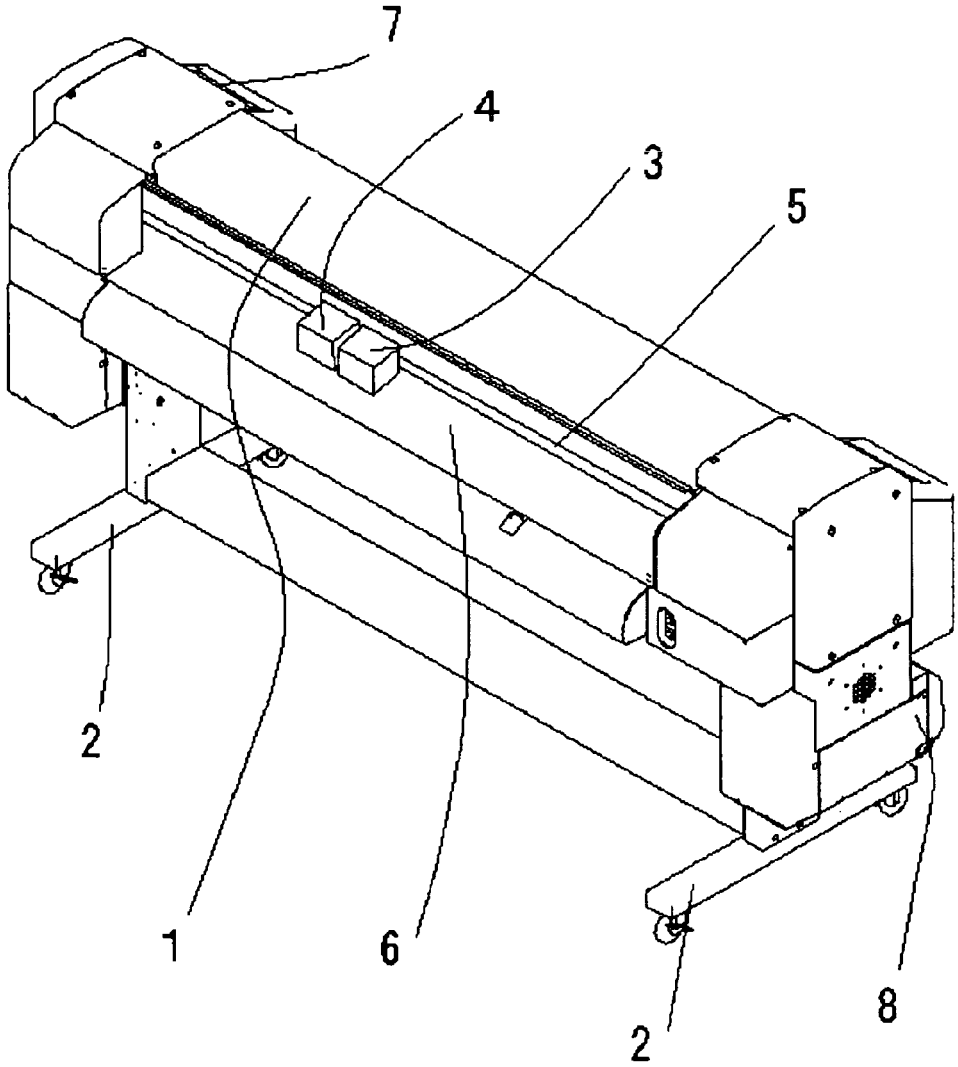
FIG. 1 is a schematic view of an image forming and image cutting apparatus according to the present invention.

3 inkjet head
4 cutting head
10 first coupling member
11 second coupling member
12 solenoid
13 coupling pin
14 first sensor
15 second sensor
16 scale

DETAILED DESCRIPTION OF THE PREFERRED EMBODIMENT

Hereinafter, a description is made of an image forming and image cutting apparatus according to an embodiment of the present invention with reference to the drawings.

FIG. 1 is a schematic view of the image forming and image cutting apparatus according to the present invention. An image forming and image cutting apparatus 1 is an image forming and image cutting apparatus including an inkjet head 3 that discharges ink for printing, and a cutting head 4 including a cutter blade for cutting a recording medium. A stand 2 is a base that supports the image forming and image cutting apparatus 1. A guide rail 5 is a support member that enables reciprocal movement of the inkjet head 3 and the cutting head 4. A platen 6 is disposed under the inkjet head 3 and the cutting head 4, and supports a recording medium. An operation panel 7 includes a lamp for indicating a state of the apparatus and an input switch for setting various functions. An ink holder 8 is a holder to which an ink cartridge is fixed. A desired image is formed on a recording medium with the use of the inkjet head 3, based on an instruction contained in image data. Further, the recording medium may be cut with the use of the cutting head 4 including the cutter blade, based on an instruction contained in the image data.

Figure 2A:
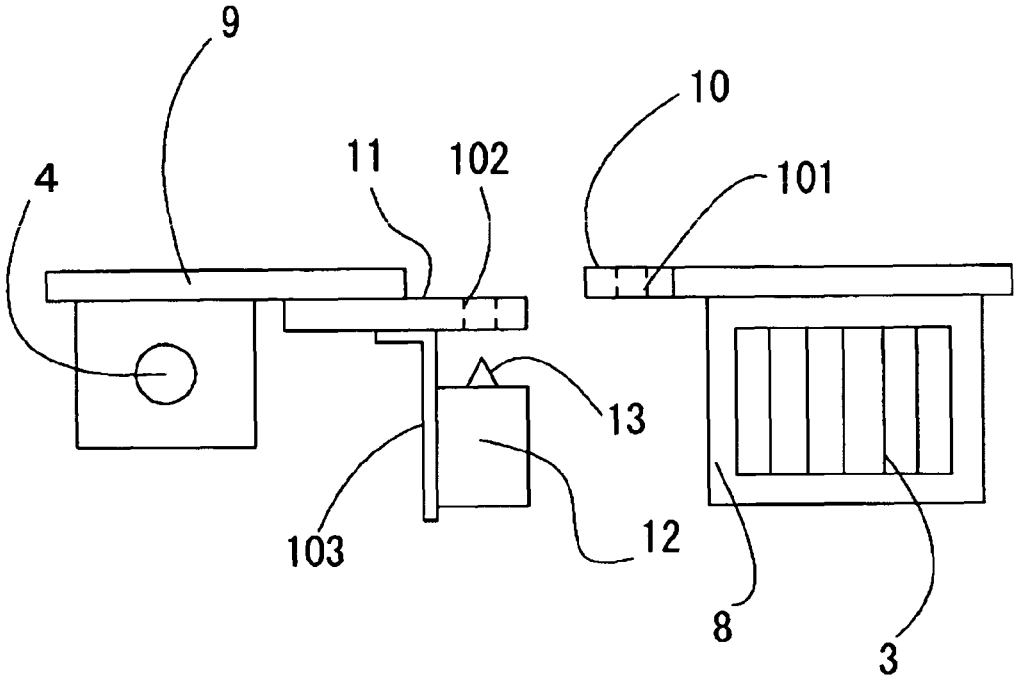
Figure 2B:
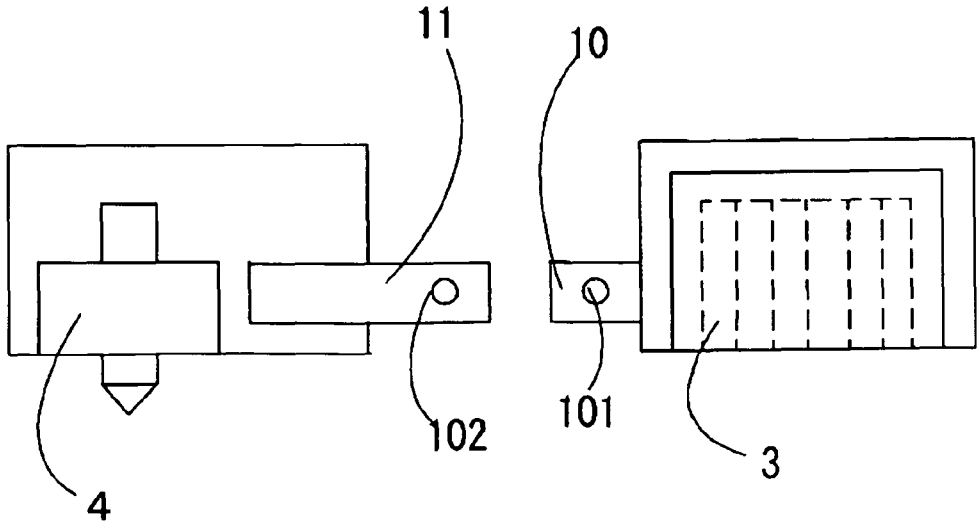

Next, an operation of coupling the inkjet head 3 and the cutting head 4 is described. FIGS. 2A and 2B are views each illustrating a separated or de-coupled state of the inkjet head 3 and the cutting head 4. FIG. 2A is a front view, and FIG. 2B is a top view.

An inkjet head carriage 8 fixes the inkjet head 3, and reciprocally moves along the guide rail 5 in the width direction of the recording medium. A cutting head carriage 9 fixes the cutting head, and reciprocally moves along the guide rail 5 in the width direction of the recording medium. A first coupling member 10 is attached to the inkjet head carriage 8. A second coupling member 11 is attached to the cutting head carriage 9. A solenoid 12 is attached to the cutting head carriage 9. A coupling pin 13, which may be moved by the solenoid 12, is provided to the solenoid 12. The coupling pin 13 fixes the first coupling member 10 and the second coupling member to thereby couple the inkjet head carriage 8 and the cutting head carriage 9 with each other.

The operation of coupling and separating (de-coupling) the inkjet head 3 and the cutting head 4 of the image forming and image cutting apparatus according to the present invention is realized by aligning the second coupling member 11 attached to the cutting carriage 9 with the first coupling member 10 attached to the inkjet carriage 8, and driving the solenoid 12 attached to the cutting head carriage 9 to cause the coupling pin 13 to pass through the first coupling member 10 and the second coupling member 11. In forming an image, the solenoid 12 is driven to extrude the coupling pin 13, the coupling pin 13 passes through the first coupling member 10 and the second coupling member 11 to place the first coupling member 10 and the second coupling member 11 in a coupled state, and in the coupled state, the cutting head carriage 9 and the inkjet head carriage 8 are integrally driven. In cutting an image, the solenoid 12 is driven to retract the coupling pin 13, the first coupling member 10 and the second coupling member 11 are separated or de-coupled from each other, and the cutting head carriage 11 alone is driven while the inkjet head carriage 10 is placed at a maintenance station with the head capped.

The first coupling member 10 is a plate member of the inkjet head carriage 8, which protrudes toward the cutting head carriage 9 side. The first coupling member 10 is provided with a penetration side wall 101 forming a through hole into which the coupling pin 13 is inserted. The second coupling member 11 is a plate member of the cutting head carriage 9, which protrudes toward the inkjet head carriage 8 side. The second coupling member 11 is provided with a penetration side wall 102 forming a through hole into which the coupling pin 13 is inserted. The solenoid 12 is disposed to the cutting head carriage 9 so as to align the coupling pin 13 with a position at which the coupling pin 13 may pass through inside the penetration side wall 102. The solenoid 12 is fixed to a substantially L-shaped plate 103, thereby fixing the substantially L-shaped plate 103 to the second coupling member 11. With this configuration, alignment between the penetration side wall 102 of the second coupling member 11 and the coupling pin 13 is enabled on the second coupling member 11. The first coupling member 10 and the second coupling member 11 are arranged such that, when the cutting head carriage 9 is driven to approach the inkjet head carriage 8, the first coupling member 10 and the second coupling member 11 overlap each other in a moving direction of the coupling pin 13 without colliding with each other.

Figure 3A:
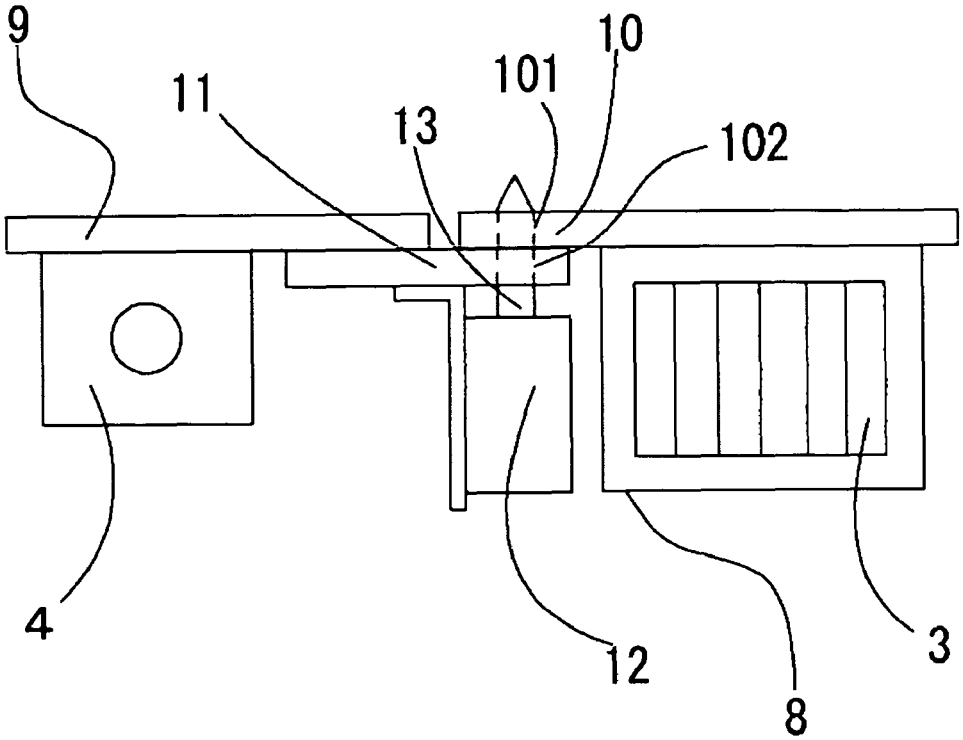
Figure 3B:
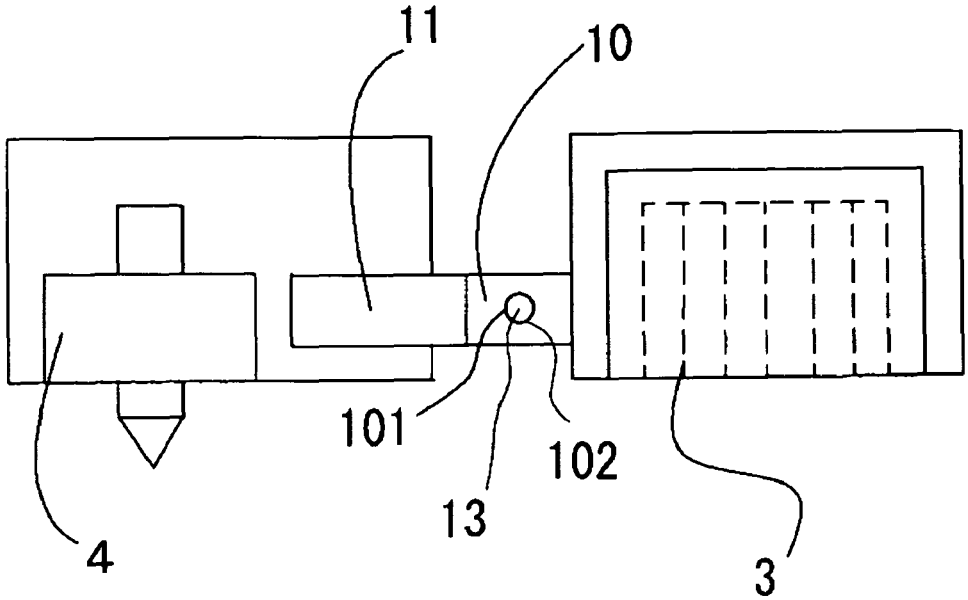

FIGS. 3A and 3B are views each illustrating a coupled state of the inkjet head 3 and the cutting head 4. FIG. 3A is a front view, and FIG. 3B is a top view. The solenoid 12 is driven to move the coupling pin 13. The coupling pin 13 passes through inside the penetration side wall 101 of the first coupling member 10 and the penetration side wall 102 of the second coupling member 11 to fix the first coupling member 10 and the second coupling member 11, thereby coupling the cutting head carriage 9 and the inkjet head carriage 8 with each other.

Figure 4A:
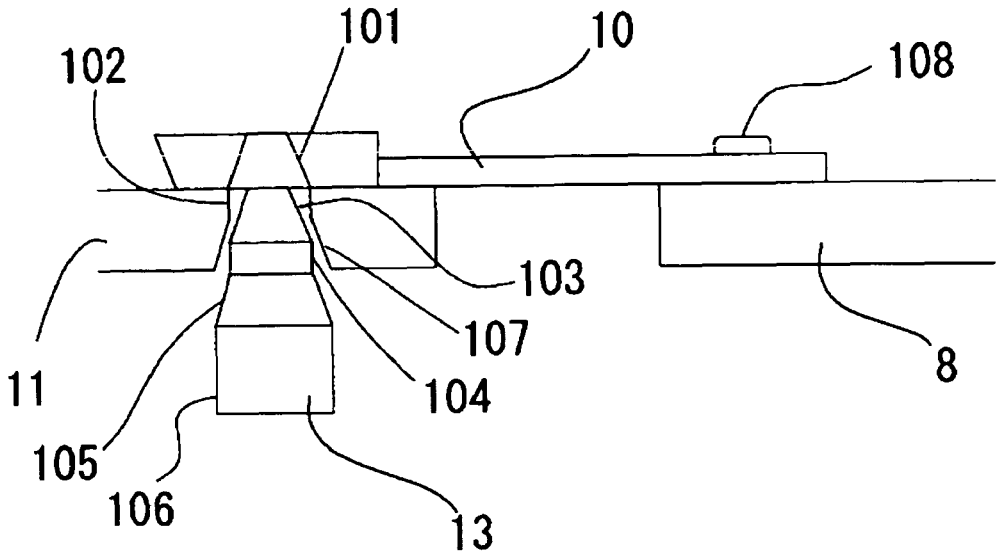
Figure 4B:
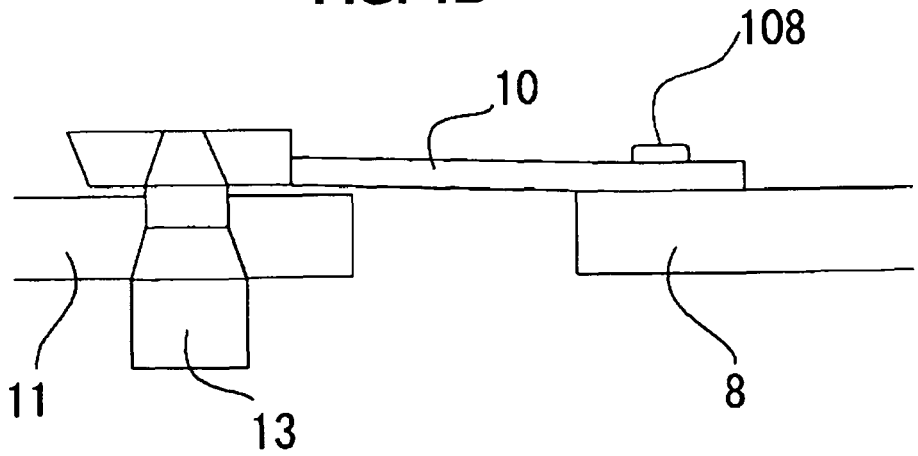

Next, a description is made of the first coupling member 10 attached to the inkjet head carriage 8, and the second coupling member 11 and coupling pin 13 attached to the cutting head carriage 9. FIGS. 4A-4B are views each illustrating an operation of the coupling pin. Each of the first coupling member 10 and the second coupling member 11 has a hole processed to have a shape identical with that of the coupling pin 13. The coupling pin 13 has a shape in which a stepped column is subjected to taper processing. The coupling pin 13 includes a first tapered portion 103, a first columnar portion 104, a second tapered portion 105, and a second columnar portion 106 in the stated order from the tip end of the coupling pin 13. The first penetration side wall 101 has a shape corresponding to the shape of the first tapered portion 103. The second penetration side wall 102 has its upper portion 106 in a shape corresponding to the shape of the first columnar portion 104, but the upper portion 106 is lower in height than the first columnar portion 104. The second penetration side wall 102 has its lower portion 107 in a shape corresponding to the shape of the second columnar portion 106. The cross sections of the first tapered portion 103 and the second tapered portion 105 decrease in area in the direction of the tip end of the coupling pin 13. The first columnar portion 104 is smaller in diameter than the second columnar portion 106. The first coupling member 10 is an elastic member formed of a leaf spring. The first coupling member 10 is fixed at its base to the inkjet head carriage 8 by means of a fixing member 108. As illustrated in FIG. 4B, the coupling pin 13 is driven and pushed up by the solenoid 12, and when the second tapered portion 105 is fitted into the lower portion 107 of the second penetration side wall 102, the coupling pin 13 and the second coupling member 11 are fixed without any backlash. In addition, the first coupling member 10 is formed of the leaf spring, and hence, when the first coupling member 10 is pressed and deflected by the coupling pin 13, the first tapered portion 103 of the coupling pin 13 matches the first penetration side wall 101 of the coupling member 10 and is fitted thereinto. Accordingly, the coupling pin 13 and the first coupling member 10 are fixed without any backlash.

Figure 5:
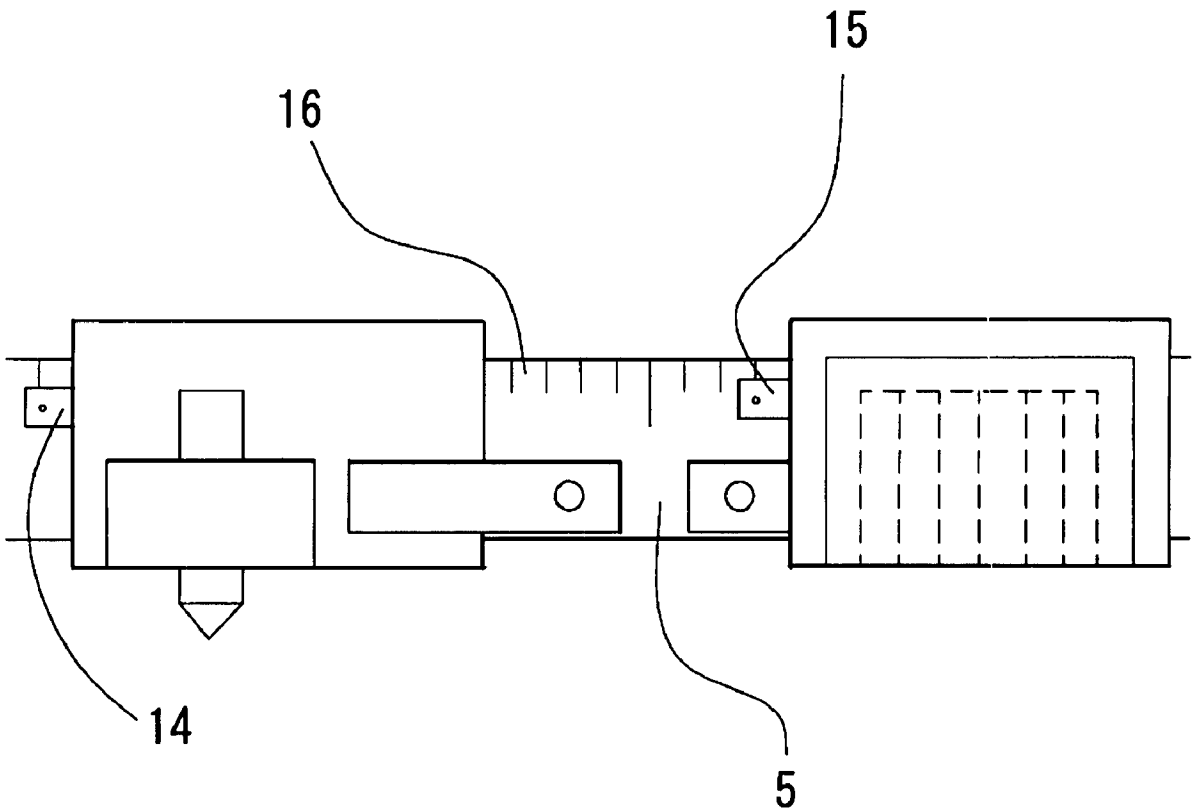
FIG. 5 is a configuration diagram of a position detection system for the inkjet head and the cutting head of the image forming and image cutting apparatus according to the present invention.

Next, a description is made of means for detecting positions of the first coupling member 10 and the second coupling member 11 attached to the inkjet head carriage 8 and the cutting head carriage 9, respectively. FIG. 5 is a configuration diagram of a position detection system for the inkjet head carriage 8 and the cutting head carriage 9. A first sensor 14 is a sensor attached to the cutting head carriage 9, and a second sensor 15 is a sensor attached to the inkjet head carriage 8. A scale 16 is a scale attached to the guide rail. The first coupling member 10 and the second coupling member 11 are attached at predetermined positions on the inkjet head carriage and the cutting head carriage, respectively. Reading and calculating values detected by the first sensor 14 and the second sensor 15 enables to determine where the inkjet head carriage 8 and the cutting head carriage 9 are located on the guide rail 5. The cutting head carriage 9 is driven according to the determined positions to align the first coupling member 10 and the second coupling member 11. It is desirable that the cutting head carriage 9 move to a position at which the coupling pin 13 may be inserted into the inside of the first penetration side wall 101 when the coupling pin 13 is moved, more desirably, a position at which outlines of the first penetration side wall 101 and the second penetration side wall 102 coincide with each other.

The present invention is applicable to coupling between the inkjet head that prints an image formed based on image data on a recording medium and another device such as the cutting head that cuts the recording medium.

What is claimed is:

1. An image forming and cutting apparatus comprising:

a guide rail;

an inkjet head mounted to undergo movement along the guide rail to print an image on a recording medium;

a cutting head mounted to undergo movement along the guide rail to cut the recording medium on which an image has been printed;

a first coupling member mounted on the inkjet head;

a second coupling member mounted on the cutting head; and a coupling pin mounted for undergoing movement in a first direction to couple the first coupling member to the second coupling member and in a second direction to de-couple the first coupling member from the second coupling member, each of the first and second coupling members having a hole configured to receive the coupling pin when the coupling pin undergoes movement in the first direction to couple the first and second coupling members to one another;

wherein the coupling pin has a first tapered portion, a second tapered portion, and a columnar portion disposed between the first and second tapered portions;

wherein the hole of the first coupling member has a tapered surface for receiving the first tapered portion of the coupling pin, and the hole of the second coupling member has a tapered surface portion and a columnar surface portion for receiving the second tapered portion and the columnar portion, respectively, of the coupling pin; and wherein the first coupling member is made of an elastic material and is configured to be pressed and deflected by the coupling pin due to elasticity of the elastic material when the coupling pin is moved in the first direction and is received by the holes of the first and second coupling members so that the first and second coupling members are coupled to one another with a gap therebetween while the columnar portion of the coupling pin protrudes from the hole of the second coupling member.

2. An image forming and cutting apparatus according to claim 1; further comprising moving means for selectively moving the coupling pin in the first and second directions.

3. An image forming and cutting apparatus according to claim 2; wherein the moving means comprises a solenoid mounted on the cutting head.

4. An image forming and cutting apparatus according to claim 1; wherein when the first and second coupling members are coupled together, the inkjet head and the cutting head are configured to integrally undergo movement along the guide rail to print an image on the recording medium with the inkjet head; and wherein when the first coupling member is de-coupled from the second coupling member, the cutting head is configured to undergo movement without the inkjet head along the guide rail to cut the recording medium on which the image has been printed.

5. An image forming and cutting apparatus according to claim 1; further comprising a detection device that detects positions of the holes of the first and second coupling members along directions of movement of the inkjet head and the cutting head.

6. An image forming and cutting apparatus according to claim 1; wherein the coupling pin is not integral with the first coupling member or the second coupling member.

7. An image forming and cutting apparatus for printing an image on a recording medium and cutting the recording medium on which the image has been printed, the image forming and cutting apparatus comprising:

a coupling pin mounted for undergoing movement to different first and second positions, the coupling pin having a first tapered portion, a second tapered portion, and a columnar portion disposed between the first and second tapered portions;

an inkjet head for printing a desired image on a recording medium, the inkjet head having a first coupling member formed of an elastic material, the first coupling member having a first hole provided with a tapered surface configured to receive the first tapered portion of the coupling pin when the coupling pin is in the first position;

a cutting head for cutting the recording medium on which a desired image has been printed, the cutting head having a second coupling member with a second hole provided with a tapered surface portion and a columnar surface portion configured to receive the second tapered portion and the columnar portion, respectively, of the coupling pin when the coupling pin is in the second position; and moving means for moving the coupling pin to the second position to couple the first coupling member to the second coupling member by causing the second tapered portion and the columnar portion of the coupling pin to be received by the tapered surface portion and the columnar surface portion, respectively, of the second hole, and by causing the first tapered portion of the coupling pin to be received by the first tapered portion of the first hole while the first coupling member is pressed and deflected by the coupling pin due to elasticity of the elastic material and the columnar portion of the coupling pin protrudes from the second hole so that the first and second coupling members are coupled together with a gap therebetween.

8. An image forming and cutting apparatus according to claim 7; wherein the moving means comprises a solenoid mounted on one of the ink jet head and the cutting head.

9. An image forming and cutting apparatus according to claim 8; wherein the solenoid is mounted on the cutting head.

10. An image forming and cutting apparatus according to claim 7; further comprising a guide rail; and wherein the inkjet head and the cutting head are mounted to undergo movement along the guide rail to print an image on a recording medium and to cut the recording medium on which an image has been printed, respectively.

11. An image forming and cutting apparatus according to claim 10; wherein when the first and second coupling members are coupled together, the inkjet head and the cutting head are configured to integrally undergo movement along the guide rail to print an image on the recording medium with the inkjet head; and wherein when the first coupling member and the second coupling member are not coupled together, the cutting head is configured to undergo movement without the inkjet head along the guide rail to cut the recording medium on which the image has been printed.

12. An image forming and cutting apparatus according to claim 7; further comprising a detection device that detects positions of the first and second holes of the first and second coupling members, respectively, along directions of movement of the inkjet head and the cutting head.

13. An image forming and cutting apparatus according to claim 7; wherein the coupling pin is not integral with the first coupling member or the second coupling member.

* * * * *